United States Patent [19]

Richter et al.

[11] Patent Number: 5,064,101

[45] Date of Patent: Nov. 12, 1991

[54] FIVE GALLON NESTABLE PLASTIC SYRUP CONTAINER

[75] Inventors: Simon J. Richter, Marietta, Ga.; Frank G. Hohmann, Denville, N.J.

[73] Assignee: The Coca-Cola Company, Atlanta, Ga.

[21] Appl. No.: 429,553

[22] Filed: Oct. 31, 1989

[51] Int. Cl.[5] ..... B67D 5/60

[52] U.S. Cl. ..... 222/143; 222/464; 222/541; 222/501; 206/510; 215/10; 251/343; 141/351

[58] Field of Search ..... 222/501, 465 R, 478, 222/541, 464, 143, 1; 141/351-354; 215/10, 315; 251/339, 336, 343; 206/509, 510, 512; 220/23.6, 23.83, 4.16, 4.17

[56] References Cited

U.S. PATENT DOCUMENTS

| | | | |
|---|---|---|---|
| 456,934 | 8/1891 | Bartley et al. | 222/464 X |
| 2,051,736 | 8/1936 | Misfeldt | 222/464 X |
| 2,536,400 | 10/1946 | Thompson . | |
| 3,176,879 | 4/1965 | Mojonnier | 222/143 |
| 3,323,681 | 6/1967 | DiVette et al. . | |
| 3,369,688 | 2/1968 | Dike | 222/143 X |
| 3,942,688 | 3/1976 | Pryor et al. | 222/464 X |
| 4,113,129 | 9/1978 | Cambio, Jr. | 222/541 X |
| 4,247,018 | 12/1979 | Credle . | |
| 4,371,015 | 2/1983 | Simons | 141/352 |
| 4,606,476 | 8/1986 | Pocock et al. | 141/351 X |
| 4,640,446 | 2/1987 | Walker | 222/464 X |
| 4,805,793 | 2/1989 | Brandt et al. | 222/143 X |
| 4,832,200 | 5/1989 | Deaton et al. | 206/509 X |
| 4,892,125 | 1/1990 | Rudick et al. | 141/353 |
| 4,913,316 | 4/1990 | Richter | 222/464 X |

*Primary Examiner*—Michael S. Huppert
*Assistant Examiner*—Kenneth De Rosa
*Attorney, Agent, or Firm*—Birch, Stewart, Kolasch and Birch

[57] ABSTRACT

A disposable and recyclable plastic container for use in a post-mix beverage dispensing system includes first and second openings at a top end thereof. The container may be filled with syrup through the first opening and withdrawn by a pump through the second opening. The second opening is defined by an upper end of a tube, which is integrally formed with the container by blow-molding. The tube extends from the top end of the container, down the exterior of the container sidewall and through the bottom. As syrup is withdrawn, the first opening, or an associated vent, vents the container to assist the withdrawl of syrup. The second opening and tube have a valve actuator therein for a spring-loaded valve in a conventional quick-disconnect coupling such as used in bag-in-box type systems. The top and bottom of the container have complementary shapes to permit vertical nesting and stacking of plural like containers.

10 Claims, 5 Drawing Sheets

FIVE GALLON NESTABLE PLASTIC SYRUP CONTAINER

BACKGROUND OF THE INVENTION

The present invention relates to a plastic container for syrup or flavor concentrate suitable for use with a post-mix beverage dispenser. More specifically, the present invention relates to a disposable and recyclable container for storing syrup or flavor concentrate, said container being connectable to a syrup pump which withdraws the syrup or flavor concentrate from the container and supplies it to a mixing station in the post-mix dispenser.

Post-mix beverage dispensers, such as those used in fast-food restaurants or the like, generally store the syrup in either a stainless steel, pressurized container with a five-gallon capacity, or a bag-in-box type of container. The stainless steel type of container is known as a "Figal", an accepted abbreviation in the beverage dispensing art for a syrup container with a five-gallon capacity fabricated primarily of stainless steel. "Figal" containers are generally described in U.S. Pat. No. 3,186,577 to Tennison. The Figal container is advantageous in that the syrup therein is stored under pressure, eliminating the need for a pump to withdraw syrup therefrom. However, a "Figal" container has a disadvantage of being very expensive to manufacture, so it must be returned to the factory, sanitized and reused.

In contrast, bag-in-box packages for syrup are disposable and less expensive. However, bag-in-box type packages are not easily recyclable, so an associated waste disposal problem results. A typical bag-in-box type package is disclosed in U.S. Pat. No. 4,286,636 to Credle.

Bag-in-box packages of the general type disclosed in the Credle '636 Patent are in wide use today in beverage dispensing systems which include air-operated reciprocating pumps coupled between the bag-in-box package and a dispenser nozzle by a quick-disconnect coupling. An example of such a quick-disconnect coupling is also illustrated in the Credle '636 Patent.

Accordingly, a need in the art exists for a disposable, inexpensive syrup container for use with a post-mix beverage dispenser, which is also recyclable.

SUMMARY OF THE INVENTION

Accordingly, it is a primary object of the present invention to provide a disposable and recyclable plastic syrup container in lieu of a conventional bag-in-box type of container.

It is another object of the present invention to provide a disposable and recyclable syrup container which can be connected to similar equipment used with bag-in-box type containers, such as a syrup pump by conventional quick-disconnect couplings.

The objects of the present invention are fulfilled by providing a disposable container for storing and dispensing liquid concentrate comprising:

a top end defining a first opening through which said container may be filled and a second opening through which concentrate may be withdrawn;

vent means associated with said first opening for controlling the flow of air into the container as concentrate is withdrawn from said second opening;

a base end for supporting said container in an upright position;

sidewalls connecting said base end to said top end;

a conduit extending along said sidewalls outboard of said container from the top end to the bottom end, said conduit defining said second opening at said top end of said container, said conduit being in liquid communication with the inside of said container at the bottom end thereof; and valve actuator means within said second opening for use in operating a valve in a coupling connectable to said second opening.

The coupling connectable to the second opening may be a conventional quick-disconnect coupling on the end of a flexible hose. This coupling includes a spring-loaded valve poppet which is pushed open by the valve actuator means within the second opening of the container of the present invention.

The hose leading from the quick-disconnect coupling runs to the input side of a reciprocating pump which has the output side thereof coupled to the dispenser valves of the post-mix dispenser.

BRIEF DESCRIPTION OF THE DRAWINGS

The objects of the present invention and the attendant advantages thereof will become more readily apparent by reference to the drawings wherein like numerals refer to like parts and wherein.

DESCRIPTION OF PREFERRED EMBODIMENTS

Figure 1A:
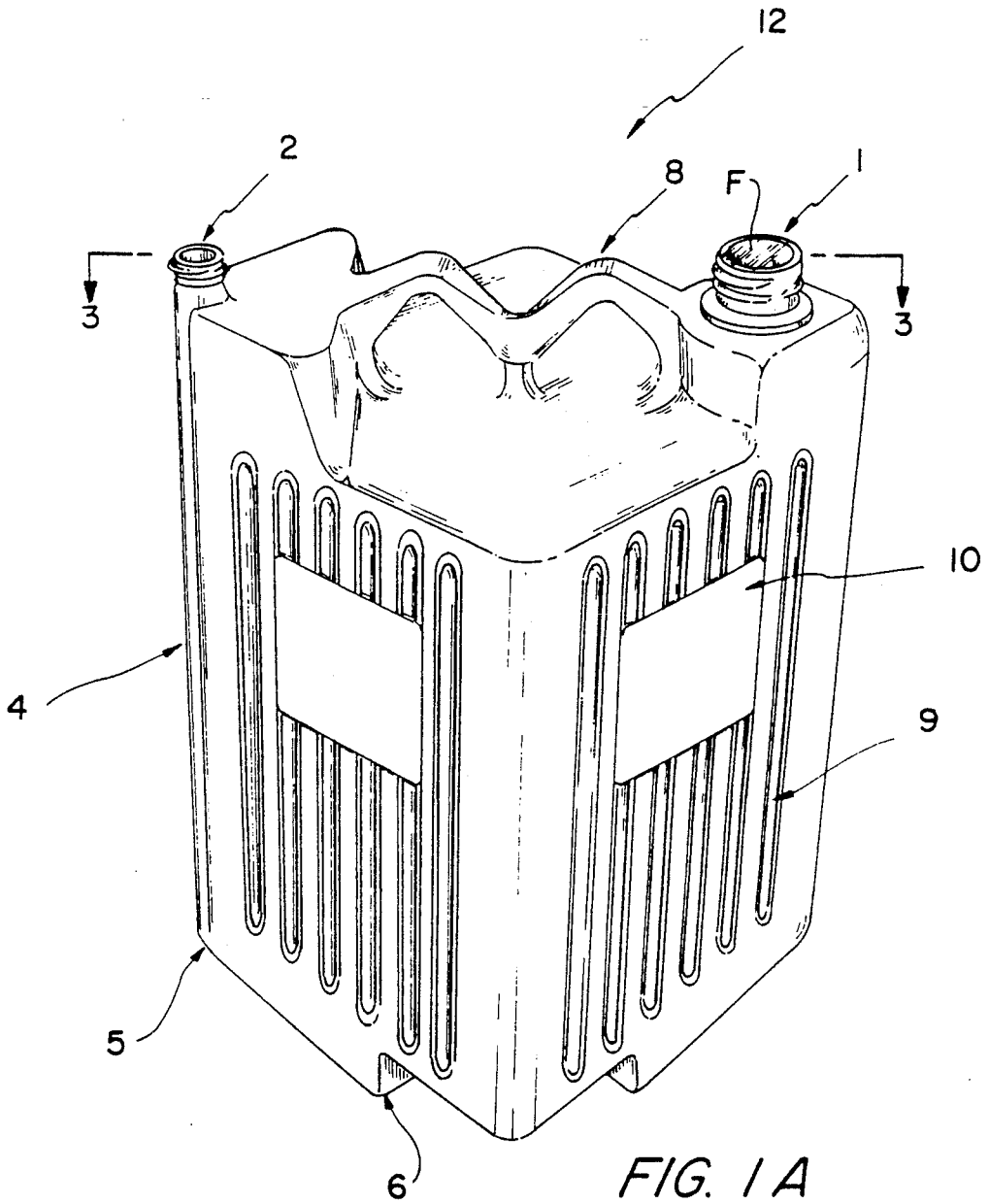
FIG. 1A is a top front perspective view illustrating a preferred embodiment of the syrup container of the present invention.
Figure 1B:
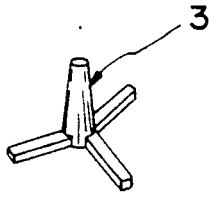
FIG. 1B is an enlarged view of a valve actuator secured within the smaller of the two openings in the top end of the container of FIG. 1A.
Figure 3:
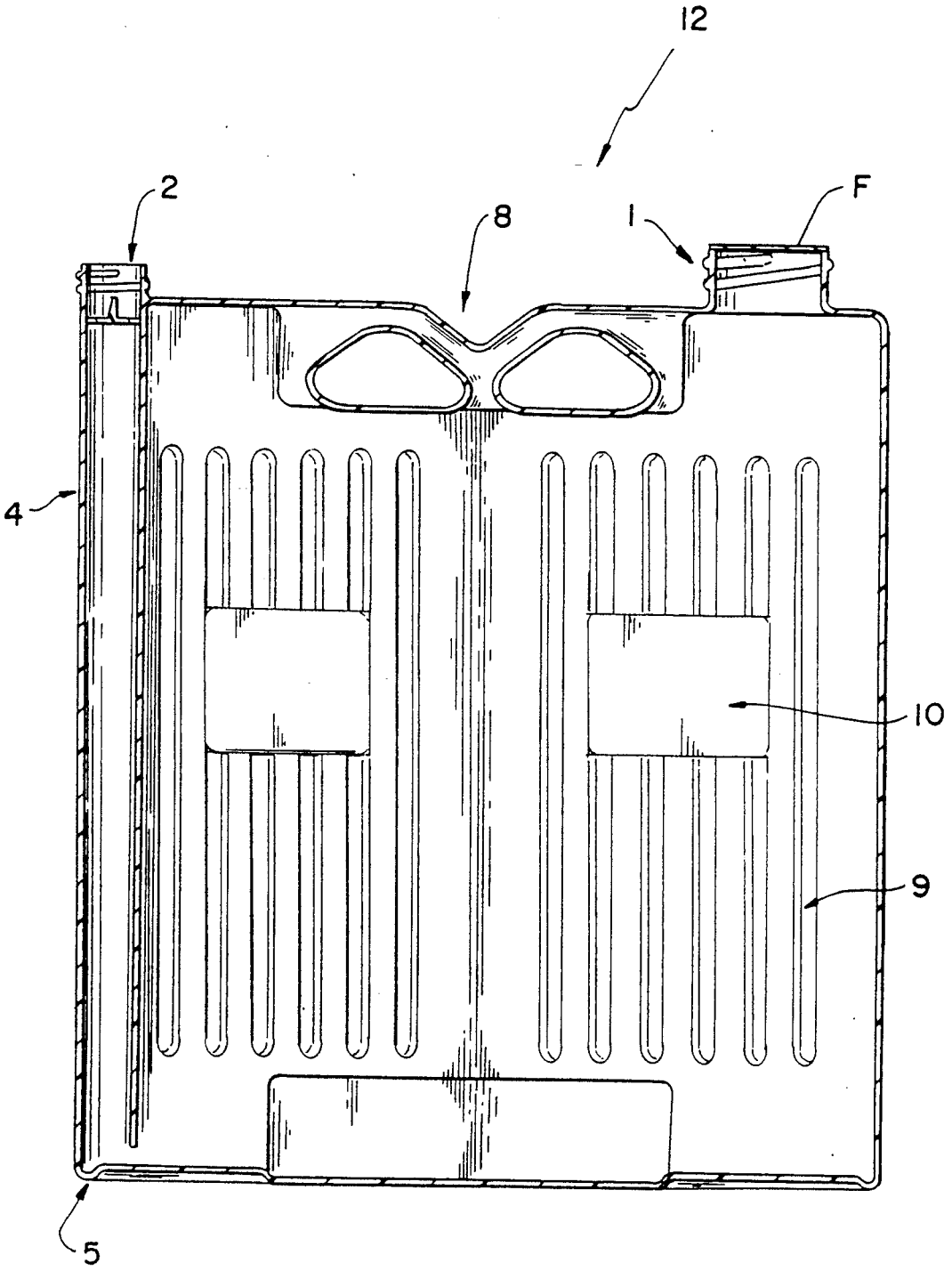
FIG. 3 is a cross-sectional view taken along line 3—3 of the container of FIG. 1.

Referring to FIGS. 1 and 3, there is illustrated the syrup container 12 of the present invention including a first opening 1 and a second opening 2. Opening 1 is larger than opening 2 and is defined by a protruding cylindrical neck on the top end of the container 12, which has an appropriate finish or threads thereon for receiving a protective cap. Opening 1 also is preferably sealed by a foil F which is frangible to form an appropriate vent opening for reasons to be described hereinafter. The smaller opening 2 is defined by a cylindrical tube or conduit 4 which extends from the top end of container 12 to the bottom end 5 thereof. The top end of tube 4, which defines opening 2, is also provided with appropriate threads or finish to receive a protective screw cap which covers opening 2 during storage and transportation. Conduit 4 passes through the bottom end 5 of the container into fluid communication with the interior of the container so that syrup within the container may be withdrawn through conduit 4 and opening 2 once the associated cap is removed, and conduit 4 is fluidly coupled to an appropriate syrup pump, to be described hereinafter.

The larger opening 1 in the top end of the container is initially provided for filling the container with syrup or flavor concentrate, but during dispensing of syrup through conduit 4 opening 1 or an opening formed in the frangible foil F functions as a vent means for the container.

As illustrated in FIG. 1A, a plastic valve actuator, or insert, 3 is provided having three legs defining a spider, and a vertical prong which is secured within conduit 4 just below the opening 2. The legs sit on the bottom of the opening or may optionally be snap-fit to the inner walls of conduit 4.

The entire container 12 of FIG. 1 is preferable blow molded from a plastic material such as polyethylene in such a manner that conduit 4 is integrally formed with the rest of the container.

Figure 2:
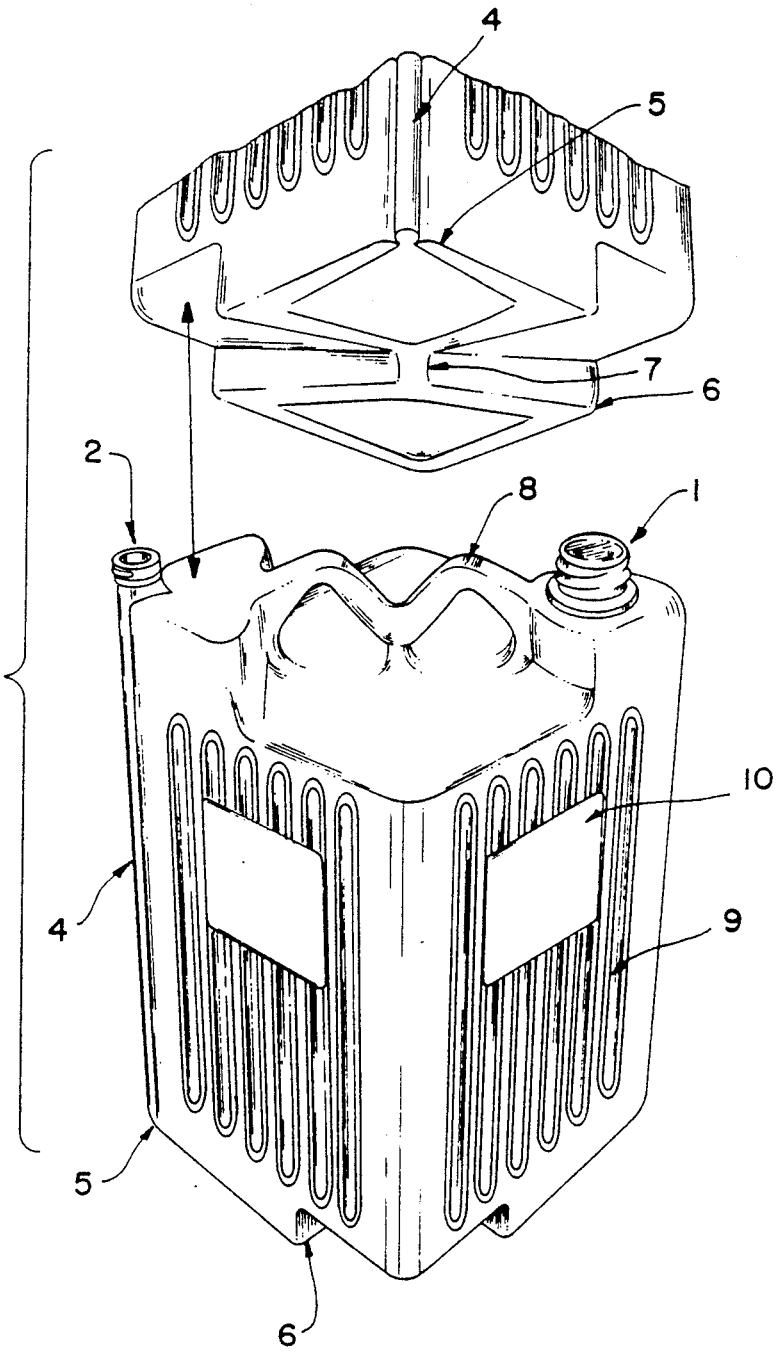
FIG. 2 is a view illustrating how the bottom end of a container B of the same type as a container A, when rotated 90 degrees, can be stacked on top of container A in a nested, interlocked relationship.

The top end of the container is also provided with a handle 8 which is recessed in the center in order to interlock with a complementary-shaped portion of the bottom end of a container of like kind, which may be stacked thereon. The manner in which two of the containers of the present invention may be stacked one upon the other and interlocked is illustrated in FIG. 2. It can be seen that the container A of FIG. 2 (the bottom container in FIG. 2) is displaced 90 degrees from the top container B which is to be stacked thereon. It can also be seen that the top of container A and the bottom of container B (like containers) have complementary shapes in order to facilitate vertical stacking and nesting, or interlocking, of the respective container ends.

Another feature illustrated in FIG. 2 is that the bottom of the container 12 includes two sections 5 and 6 which are connected by a channel 7 in the form of a bridge in order to ensure complete drainage of the container through conduit or tube 4. In addition, the sidewalls of the container are provided with ribs 9 to provide column strength for the relatively thin, polyethylene sidewalls, as well as panels 10 which may be used for labelling with trademarks and/or logos.

Figure 4:
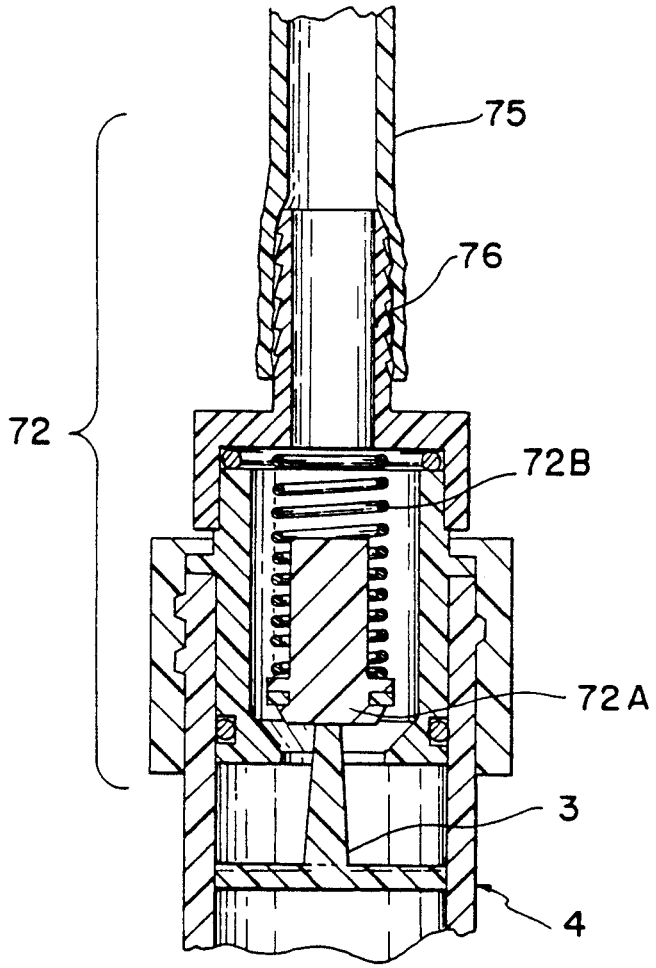
FIG. 4 is a cross-sectional view illustrating how a quick-disconnect coupling and associated flexible conduit can be coupled to the smaller of the two openings in the top end of the syrup container of FIG. 1.

Referring to FIG. 4, there is illustrated a conventional quick-disconnect coupling 72 including a spring-loaded poppet 72A which is a normally closed valve by virtue of the coil spring 72B. As illustrated in FIG. 4, when coupling 72 is screwed onto the finish of tube 4, vertical prong 3 within opening 2 pushes up against poppet 72A to open the valve, permitting the flow of liquid from tube 4 to flexible tube 75.

Figure 5:
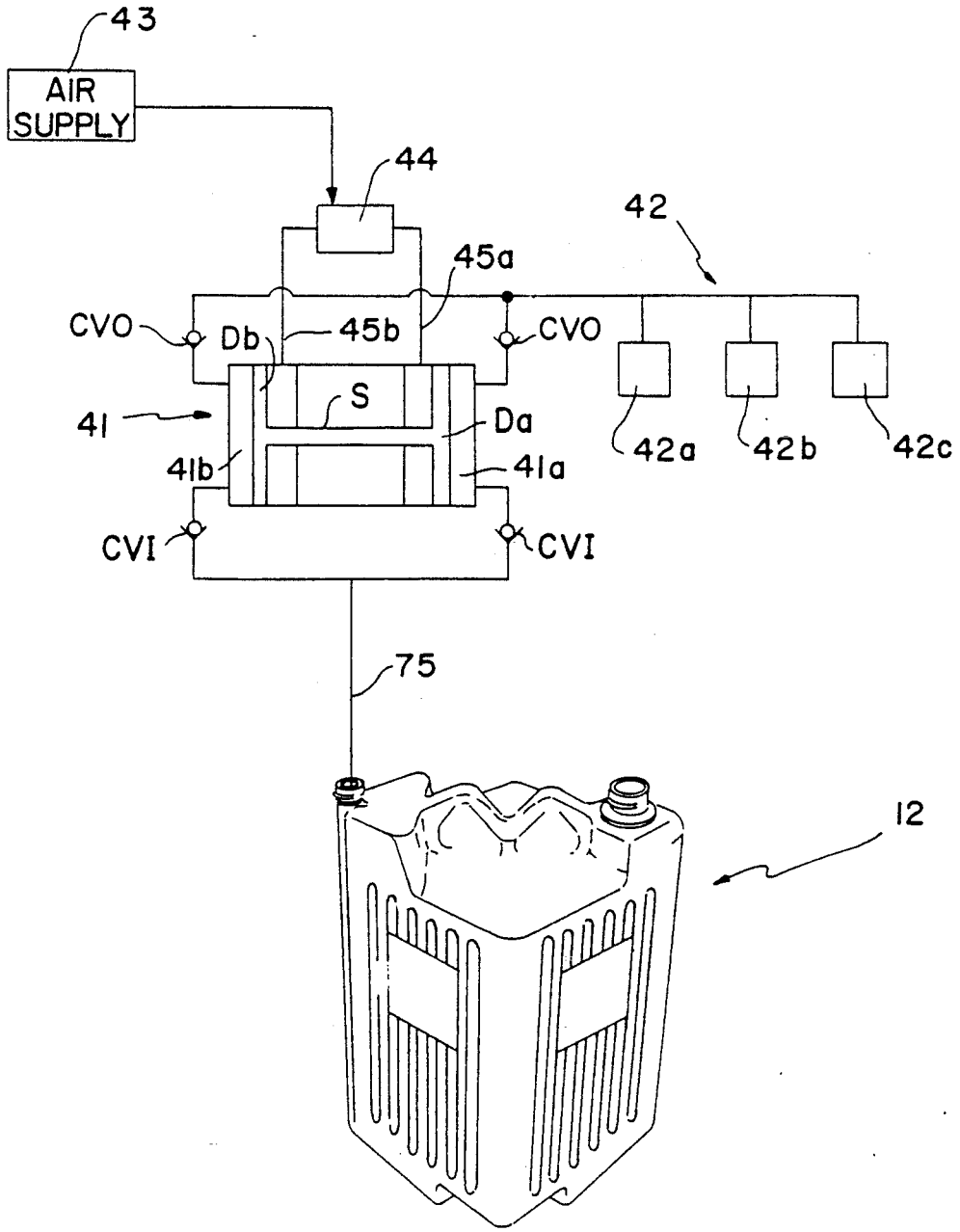
FIG. 5 is a schematic diagram of a post-mix beverage dispenser system including a double-acting reciprocating pump in combination with the syrup container of FIG. 1.

As illustrated in the dispensing system of FIG. 5, flexible tube 75 leads from container 12 to a double-acting pump 41, and is output from the pump to of a set of dispenser nozzles 42 (42*a*, 42*b*, 42*c*). The pump 41 may be a pneumatically-powered, reciprocating diaphragm pump such as disclosed in U.S. Pat. Nos. 3,741,689, 4,123,204, or 4,172,689. Such a pump typically includes a reciprocating shaft S connected between a pair of diaphragms Da, Db, and pump chambers 41*a*, 41*b*, respectively. Gas to drive the pump is alternately supplied to the inboard sides of diaphragms Da, Db by reversing valve 44 via lines 45*a*, 45*b*. As the pump reciprocates, liquid in chambers 41*a*, 41*b* on the outboard sides of diaphragms Da, Db is alternately discharged through outlet check valves CVO. Reversing valves suitable for use as valve 44 are also disclosed in the aforementioned pump patents.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A disposable container for storing and dispensing liquid concentrate comprising:

a top end defining a first opening through which said container may be filled and a second opening through which concentrate may be withdrawn;

vent means associated with said first opening for controlling the flow of air into the container as concentrate is withdrawn from said second opening;

a base end for supporting said container in an upright position;

sidewalls connecting said base end to said top end;

a conduit extending along said sidewalls outboard of said container from the top end to the bottom end, said conduit defining said second opening at said top end of said container, said conduit being in liquid communication with the inside of said container at the bottom end thereof; and valve actuator means within said second opening for use in operating a valve in a coupling connectable to said second opening;

wherein said top end has a first characteristic shape and said bottom end has a second characteristic shape such that a bottom end of one container is nestable within the top end of another container for vertical stacking and storage of a plurality of containers, said second characteristic shape including opposing base sections spaced apart by opposing recessed areas, and a channel connecting the opposing base sections to facilitate complete drainage of concentrate from the container when said container is in an upright orientation.

2. The container of claim 1 wherein said top end has a handle thereon, said handle having a portion which is interlockable with a portion of the bottom end of a like container when said containers are stacked.

3. The container of claim 2 wherein said sidewalls include vertically extending ribs.

4. The container of claim 1 wherein said vent means includes a frangible foil secured over said first opening.

5. The container of claim 1 wherein said first opening is formed in an upstanding cylindrical neck portion of said top end, said neck portion having a external finish engageable by a protective cap.

6. A system for supplying liquid concentrate to a post-mix beverage dispenser comprising:

a) a disposable container for storing and dispensing the liquid concentrate including, a top end defining a first opening through which said container may be filled and a second opening through which concentrate may be withdrawn, vent means associated with said first opening for controlling the flow of air into the container as concentrate is withdrawn from said second opening, a base end for supporting said container in an upright position, sidewalls connecting said base end to said top end, a conduit extending along said sidewalls outboard of said container from the top end to the bottom end, said conduit defining said second opening at said top end of said container, said conduit being in liquid communication with the inside of said container at the bottom end thereof, and valve actuator means within said second opening;

b) a coupling having a valve therein, said coupling being connectable to said second opening and said valve being openable by the valve actuator means in response to the connection of said coupling to said second opening;

c) a conduit connected to said coupling at one end and to an input of a pump at the other end; and d) dispenser valve means connected to an output of said pump;

d) dispenser valve means connected to an output of said pump;

wherein said top end has a first characteristic shape and said bottom end has a second characteristic shape such that a bottom end of one container is nestable within the top end of another container for vertical stacking and storage of a plurality of containers, said second characteristic shape including opposing base sections spaced apart by opposing recessed areas, and a flow-through channel connecting the opposing base sections to enable complete drainage of concentrate from the container via said conduit when said container is in an upright orientation.

7. The system of claim 6 wherein said top end has a handle thereon, said handle having a portion which is interlockable with a portion of the bottom end of a like container when said containers are stacked.

8. The system of claim 7 wherein said sidewalls include vertically extending ribs.

9. The system of claim 6 wherein said vent means includes a frangible foil secured over said first opening.

10. The system of claim 6 wherein said first opening is formed in an upstanding cylindrical neck portion of said top end, said neck portion having an external finish engageable by a protective cap.

* * * * *